United States Patent [19]

Hosaka et al.

[11] 4,155,335

[45] May 22, 1979

[54] CLOSED LOOP CONTROL SYSTEM EQUIPPED WITH CIRCUITRY FOR TEMPORARILY DISABLING THE SYSTEM IN ACCORDANCE WITH GIVEN ENGINE PARAMETERS

[75] Inventors: Akio Hosaka, Yokohama; Masaharu Asano, Yokosuka, both of Japan

[73] Assignee: Nissan Motor Company, Limited, Japan

[21] Appl. No.: 863,676

[22] Filed: Dec. 23, 1977

[30] Foreign Application Priority Data

Dec. 27, 1976 [JP] Japan ..... 51-156581
Dec. 27, 1976 [JP] Japan ..... 51-156582

[51] Int. Cl.[2] ..... F02B 33/00; F01N 3/00

[52] U.S. Cl. ..... 123/119 EC; 123/32 EA; 60/276

[58] Field of Search ..... 123/119 EC, 32 EA, 32 ED, 123/32 EC; 60/276, 285

[56] References Cited

U.S. PATENT DOCUMENTS

| | | | |
|---|---|---|---|
| 3,895,611 | 7/1975 | Endo et al. | 123/32 EE |
| 3,939,654 | 2/1976 | Creps | 60/285 |
| 3,986,352 | 10/1976 | Casey | 60/276 |
| 4,026,257 | 5/1977 | Fenn | 123/119 EC |
| 4,027,637 | 6/1977 | Aono | 123/119 EC |
| 4,029,061 | 6/1977 | Asano | 60/285 |
| 4,057,042 | 11/1977 | Aono | 60/285 |
| 4,075,982 | 2/1978 | Asano et al. | 123/119 EC |
| 4,088,095 | 5/1978 | Aono | 123/119 EC |
| 4,089,313 | 5/1978 | Asano et al. | 123/119 EC |
| 4,112,880 | 9/1978 | Asano et al. | 123/32 EA |

FOREIGN PATENT DOCUMENTS

| | | | |
|---|---|---|---|
| 2648791 | 5/1977 | Fed. Rep. of Germany | 123/119 EC |
| 2658940 | 7/1977 | Fed. Rep. of Germany | 123/119 EC |

*Primary Examiner*—Charles J. Myhre
*Assistant Examiner*—R. A. Nelli
*Attorney, Agent, or Firm*—Robert E. Burns; Emmanuel J. Lobato; Bruce L. Adams

[57] ABSTRACT

The variation range defined between the maximum and the minimum output voltages of a gas sensor in the exhaust passage is detected and compared with a reference signal which can have hysterisis characteristics. Engine operational parameters are utilized to disable and/or reactivate the system as well as the sensed sensor response, while the air-fuel ratio can be arbitrarily varied to test if the sensor is below an effective working temperature and reactivate the system.

22 Claims, 20 Drawing Figures

CLOSED LOOP CONTROL SYSTEM EQUIPPED WITH CIRCUITRY FOR TEMPORARILY DISABLING THE SYSTEM IN ACCORDANCE WITH GIVEN ENGINE PARAMETERS

FIELD OF THE INVENTION

This invention relates to a closed loop control system of the type suited to control the air fuel ratio of a combustible mixture fed to the combustion chambers of an internal combustion engine, and more particularly to a closed loop control system equipped with a device for deactivating the system when the maximum variation of a signal issued from a sensor incorporated in the system is below a predetermined value.

BACKGROUND OF THE INVENTION

In closed loop control systems which control the operation of air/fuel forming devices of internal combustion engines such as carburetor and fuel injection systems it is usual to employ a gas sensor to sense a component of the exhaust gases issued from the engine which is indicative of the air/fuel ratio of the combustible mixture being fed therein. In most cases the sensor is an oxygen sensor which uses a solid electrolyte such as zirconium.

Although the above-mentioned zirconium type oxygen sensor (as it will be referred to hereinafter) functions satisfactorily at elevated temperatures, at low temperatures the internal impedance of the zirconium (or equivalent) is so high that the maximum voltage of the output signal therefrom is exceedingly low resulting in the range defined between the minimum and maximum values of the output signal voltage being inadequate to provide accurate control by the closed loop control system. Hence erratic operation of the engine when the closed loop system is supplied with a signal (from the gas sensor) which varies within such a narrow range, is inevitable.

SUMMARY OF THE INVENTION

Hence the present invention has been developed to overcome the above-mentioned drawbacks of the prior art and provides a closed loop control system with a device for temporarily disabling or deactivating the system in accordance with the sensor of the system exhibiting an inadequately wide range in output voltage (defined between the maximum and minimum voltages) or variation range, as it will be referred to hereinafter, and/or given operational parameters of the internal combustion engine such as coolant temperature. The aforementioned device includes a disable-reactivate circuit in which the difference between the maximum and the minimum levels of the output signal is detected. The circuit further includes a comparator to which a signal representative of the aforementioned difference generated by the disable-reactivate circuit, is fed. This signal is compared with a reference signal in said comparator and an output signal is produced accordingly. The reference signal can if desired, be provided with hysterisis characteristics to prevent rapid recycling of the disable-reactivate circuit.

Therefore it is a primary object of the present invention to provide a closed loop control system equipped with a device which temporarily disables the closed loop system when a gas sensor of the system is unable to provide an adequately wide output signal variation range and thus avoid erroneous and/or undesirable operation of the closed loop system.

Another object of the present invention is to provide such a closed loop control system with which harmful components of the exhaust gas are efficiently reduced in a catalytic converter disposed in the exhaust passage.

A further object of the present invention is to provide such a system with which the operation of the engine becomes stable.

BRIEF DESCRIPTION OF THE DRAWINGS

Other features, objects and advantages of the present invention will become more readily apparent from the following detailed description taken in conjunction with the accompanying drawings in which.

Corresponding parts are designated by same reference numerals in the above-mentioned figures.

DETAILED DESCRIPTION OF THE PREFERRED EMBODIMENTS

Figure 1A:
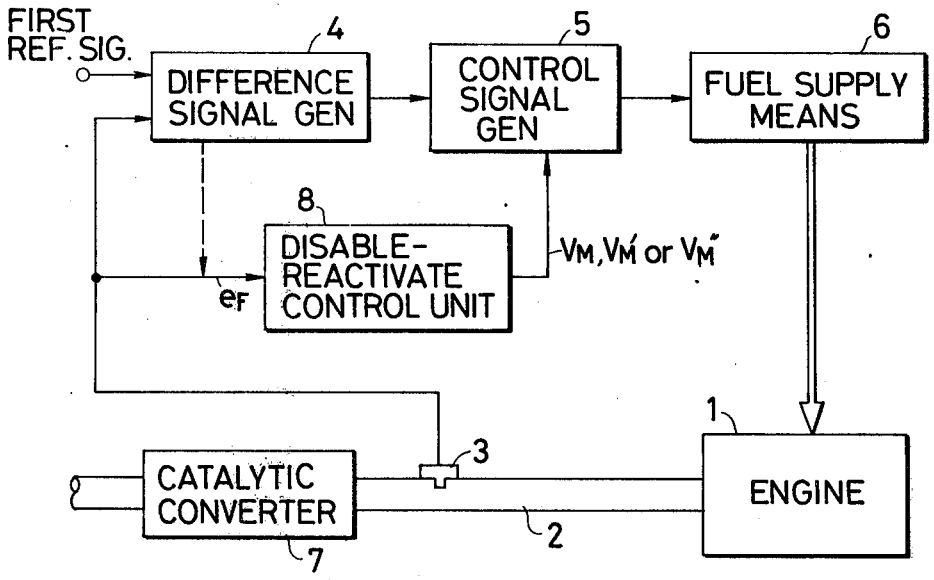
FIG. 1A shows a closed loop fuel control system which includes a disable-reactivate control circuit according to the present invention.

Reference is now made to FIG. 1A which shows a closed loop control system which includes a disable-reactivate control unit. A gas sensor 3 such as an oxygen ($O_2$) sensor is disposed in the exhaust gas passage 2 of an internal combustion engine 1. A catalytic converter 7 is shown disposed in the exhaust gas passage 2 for reducing harmful components contained in the exhaust gas. A difference signal generator 4 is arranged to produce a difference signal representative of the difference in magnitude between the output signal of the gas sensor 3 and a first reference which may represent a stoichiometric air/fuel ratio. A control signal generators 5 may include a P-I (proportional-integral) controller and is utilized for generating a control signal in response to the difference signal. The control signal is then supplied to fuel supply means 6 such as a carburetor or an injection system. The above-mentioned arrangement is the same as the conventional closed loop fuel control system with the exception that a disable-reactivate control unit 8 is further provided for disabling and reactivating the feedback control in response to the output signal $e_F$ of the gas sensor 3 and/or at least one engine parameter $S_1$ as shown in FIG. 1B which will be described hereinafter.

The output of the gas sensor 3 is connected to an input of the disable-reactivate control unit as shown in FIG. 1A. However, if it is preferable to amplify the output signal of the gas sensor 3 before being applied to the disable-reactivate control unit 8, the input of the disable-reactivate control unit 8 may be connected to an amplifier included in the difference signal generator 4 through the dotted line as shown in FIG. 1A. The output signal of the disable-reactivate control unit 8 is connected to the control signal generator 5 so as to control the control signal fed to the fuel supply means 6. The construction and the function of the disable-reactivate control unit 8 will be described hereinafter in detail along with various embodiments thereof.

Figure 1B:
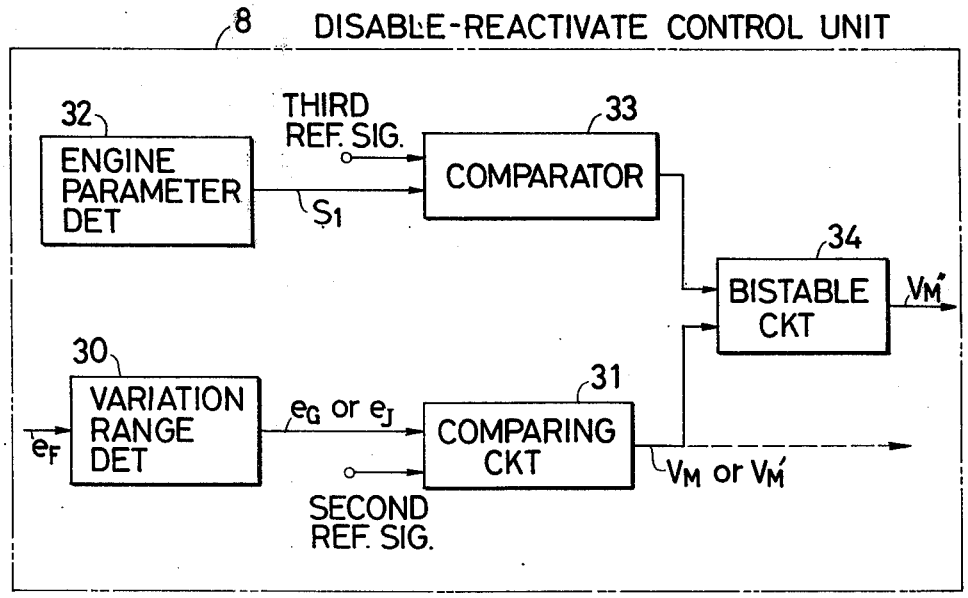
FIG. 1B shows in block diagram form a disable-reactivate control unit shown in FIG. 1A.

Reference is now made to FIG. 1B which shows in block diagram form the disable-reactivate control unit 8. The output of the gas sensor 3 shown in FIG. 1A is connected to the input of a variation range detector 30, the output of which is connected to an input of comparing circuitry 31. The output of an engine parameter detector 32 is connected to an input of a comparator 33. Second and third reference signals are respectively fed to the comparing circuitry 31 and the comparator 33. Both outputs of the comparing circuitry 31 and the comparator 33 are applied to a bistable circuit 34.

Figure 2:
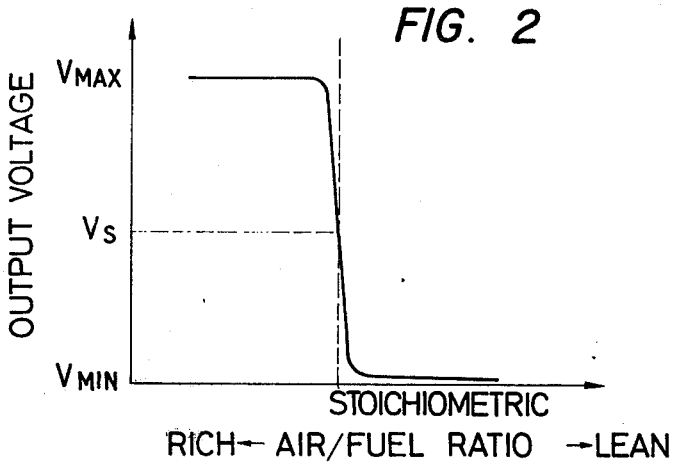
FIG. 2 is a graph which shows the air/fuel ratio-output property of a zirconium type oxygen sensor utilized in a closed loop control system.

Reference is now made to FIG. 2 which shows the air/fuel ratio to output characteristics of a gas sensor such as an oxygen sensor which uses zirconium as a solid electrolyte. As shown the output voltage of the gas sensor varies in accordance with the air/fuel ratio between the maximum voltage $V_{MAX}$ and the minimum voltage $V_{MIN}$. $V_S$ indicates a voltage which will be produced upon sensing of a stoichiometric air/fuel ratio.

Figure 3A:
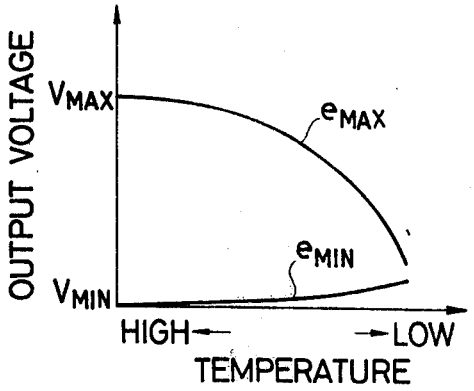
FIGS. 3A and 3B are graphs which show temperature-output property of two kinds of zirconium type oxygen sensors.
Figure 3B:
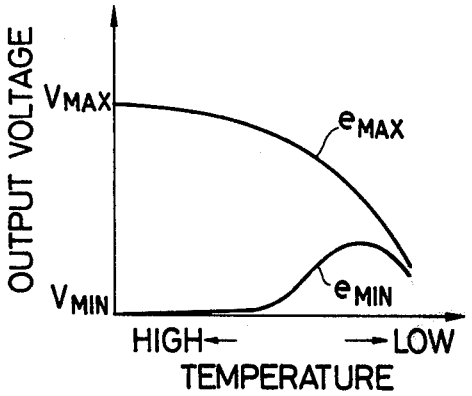

Reference is now made to FIGS. 3A and 3B which show the temperature to output property of two kinds of gas sensors. It will be understood that the difference between the maximum and minimum levels, i.e. the variation range, decreases as the temperature decreases. In case of extremely low temperature the difference approaches zero so that normal feedback control of the closed loop fuel control system cannot be accurately performed under such conditions. Hence it is preferable to disable the feedback control when the temperature is lower than a predetermined level which will be determined in accordance with the temperature-output characteristics of the gas sensor utilized in the closed loop fuel control system.

Various embodiments of the variation range detector 30 and the comparing circuitry 31 will be described hereinafter in conjunction with FIGS. 4 to 15 (except FIGS. 5A, 5B, 12, 13). For convenience, the variation range detector is denoted by numerals 30*a* to 30*e* and the comparing circuitry by numerals 31*a* to 31*f*.

Figure 4:
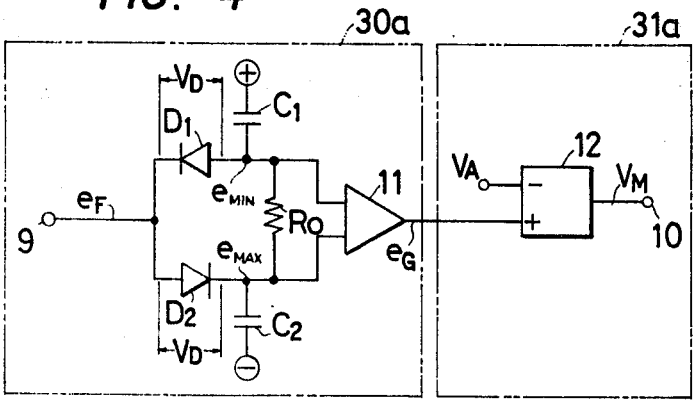
FIG. 4 shows a first embodiment of a combination of the variation range detector and the comparing circuitry shown in FIG. 1B.

Reference is now made to FIG. 4 which shows the first preferred embodiment. The circuit shown in FIG. 4 includes an embodiment 30*a*, 31*a* of the variation range detector 30 and the comparing circuitry 31 of the disable-reactivate control unit 8 shown in FIG. 1B. The cathode of a first diode $D_1$ and the anode of a second diode $D_2$ are connected to each other and further to an input terminal 9. The anode of the first diode $D_1$ is connected via a first capacitor $C_1$ to a positive power source "⊕" while the cathode of the second diode $D_2$ is connected via a second capacitor $C_2$ to a negative power source "⊖" or the ground. The anode of the first diode $D_1$ and the cathode of the second diode $D_2$ are respectively coupled to first and second inputs of a difference signal generator 11 while a resistor $R_0$ is interposed between the first and second inputs of the difference signal generator 11. The output of the difference signal generator 11 is connected to a positive input of a comparator 12 while the negative input of the comparator 12 is fed with a reference signal $V_A$. The output of the comparator 12 is connected to an output terminal 10.

The input terminal 9 is fed with an output signal $e_F$ from the gas sensor 3 shown in FIG. 1. If necessary, the output signal of the gas sensor may be amplified before being applied to the input terminal 9. The input signal $e_F$ flows through a pair of diodes $D_1$ and $D_2$ and thus a pair of capacitors $C_1$ and $C_2$ are charged and discharged in accordance with the magnitude of the input signal. The capacitors $C_1$ and $C_2$ are respectively storing a minimum potential and a maximum potential of the input signal $e_F$. One terminal of the capacitor $C_1$ is connected to the positive terminal of a power supply while the corresponding terminal of the capacitor $C_2$ is connected to the negative terminal of the same or the ground. The charged minimum and the maximum potentials of the input signal are discharged via a resistor $R_0$ connected between the two capacitors $C_1$, $C_2$ so that instantaneous minimum and maximum potentials are stored respectively in response to the fluctuation of the input signal $e_F$.

The above-mentioned minimum and maximum potentials are supplied to the difference signal generator 11 which generates an output signal $e_G$ which is in proportion to the difference between the minimum and maximum potentials. The output of the difference signal generator 11 is connected to a positive input of a comparator 12 while a reference voltage $V_A$ is applied to a negative input of the same. The comparator produces a low level output signal $V_M$ when the reference voltage is greater than the magnitude of the signal $e_G$. This means that the output signal $V_M$ is at a low level when the difference between the minimum and maximum potentials is less than a predetermined value. Therefore when the difference between the minimum and maximum potentials is greater than the predetermined value, the output signal $V_M$ is at high level. This output signal $V_M$ is fed to the control signal generator 5 so as to disable the feedback control of the closed loop fuel control system.

In order to disable the feedback control a switching circuit may be provided in parallel with a capacitor of a C-R integrator of the control signal generator 5 shown in FIG. 1A. The switching circuit may be arranged to be closed upon the presence of the output signal $V_M$ of low level so as to short the capacitor to maintain the output of the integrator constant. Another method of disabling the feedback control is performed by disconnecting the control signal generator 5 from the closed loop fuel control system and applying a given control signal from a different circuit to the fuel supply means 6 shown in FIG. 1A under the same conditions.

It will be noted that the charged potentials in $C_1$ and $C_2$ are slightly different from the minimum and maximum levels of the input signal $e_F$ respectively due to the voltage drop $V_D$ by diodes $D_1$, $D_2$.

Figure 5A:
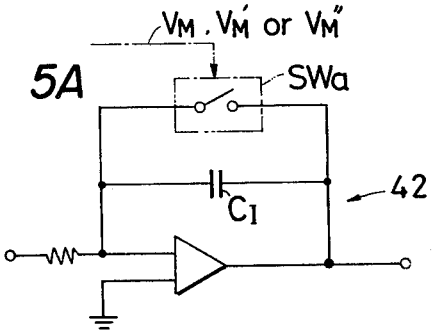
FIGS. 5A and 5B show two embodiments of disable-reactivate switching circuits connected to the control signal generator shown in FIG. 1B.

Reference is now made to FIG. 5A which shows an embodiment of a disable-reactivate switching circuit. A switching circuit $SW_a$ is connected in parallel with a capacitor $C_I$ of a C-R integrator 42 of the control signal generator 5 shown in FIG. 1A. The switching circuit $SW_a$ may be arranged to close upon the presence of the output signal $V_M$ of low level so as to short the capacitor $C_I$ to maintain the output of the integrator 42 constant.

Figure 5B:
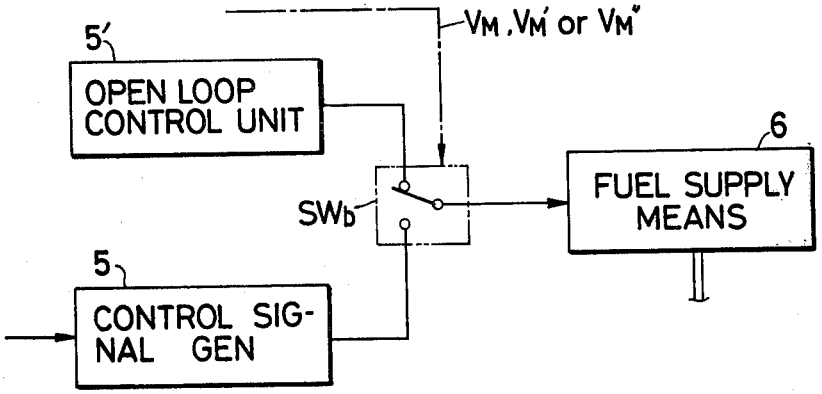

Reference is now made to FIG. 5B which shows another embodiment of a disable-reactivate switching circuit. A switching circuit $SW_b$ is interposed between the control signal generator 5 and the fuel supply means 6 while an open loop control unit 5' is provided. The output signal of the control signal generator 5 is arranged to be disconnected upon the presence of the output signal $V_M$ of low level and the output of the open loop control unit 5' is then fed to the fuel supply means 6. With this arrangement the feedback control is disabled and an open loop control is provided.

Figure 6:
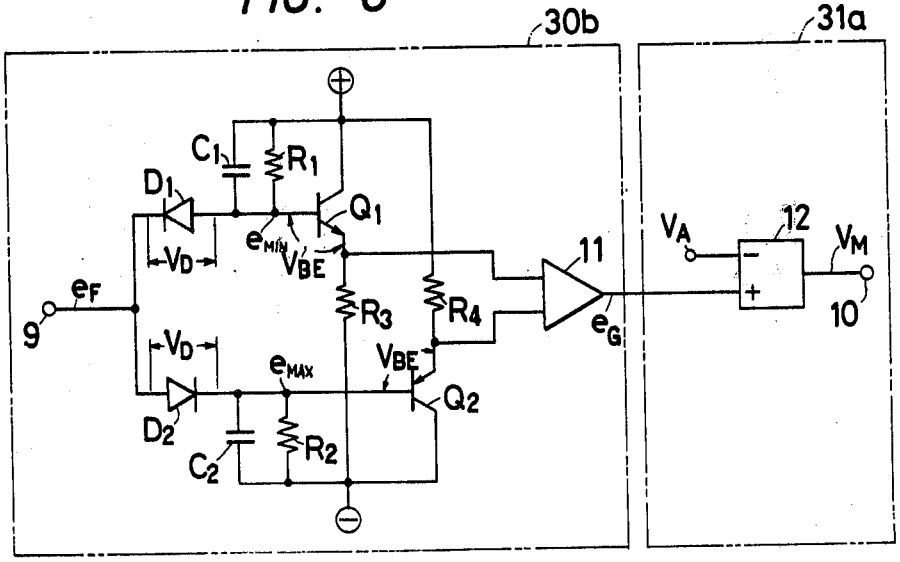
FIGS. 6 to 11 show second to seventh embodiments of combinations of the variation range detector and the comparing circuitry shown in FIG. 1B.

Reference is now made to FIG. 6 which shows a second embodiments **30*b*, 31*a* of the variation range detector 30 and the comparing circuitry 31 utilized in order to offset the above-mentioned slight difference in potentials and also to reduce the output impedance of each signal each having minimum and maximum levels. Corresponding parts are designated by the same reference numerals in this figure as in FIG. 4. A pair of transistors $Q_1$, $Q_2$ and resistors $R_1$, $R_2$, $R_3$, $R_4$ are additionally incorporated in this second embodiment. The base of the transistor $Q_1$ is coupled to the anode of the diode $D_1$ and the collector of same is connected to the positive power source while the base of the other transistor $Q_2$ is connected to the cathode of the diode $D_2$ and the collector of same to the negative power source. Resistors $R_1$ and $R_2$ are respectively provided in parallel with capacitors $C_1$, $C_2$. Resistors $R_3$, $R_4$ are respectively connected between the emitters of the transistors $Q_1$, $Q_2$ and negative and positive terminals of the power source where the emitters of both transistors $Q_1$, $Q_2$ are respectively connected to the inputs of the difference signal generator 11**.

As before-mentioned, the potential of the charge in the capacitor $C_1$ is at the minimum level. However the potential is slightly higher than the real minimum level by the forward voltage drop $V_D$ across the diode $D_1$. The transistor $Q_1$ is an n-p-n type transistor and the voltage obtained through the emitter follower circuit of same is lower than the input voltage by the voltage drop $V_{BE}$ between the base and emitter of same. Since this voltage drop $V_{BE}$ is generally close to the other voltage drop $V_D$ across the diode $D_1$, the output voltage of the transistor $Q_1$ is very close to the real minimum level. The maximum level is also compensated through the transistor $Q_2$ which is a p-n-p type transistor in the same manner. Resistors $R_1$, $R_2$ are provided for discharging the stored charges in this embodiment. Other operations in the second embodiment are the same as in the first embodiment shown in FIG. 4 and thus a description of same is omitted.

Figure 7:
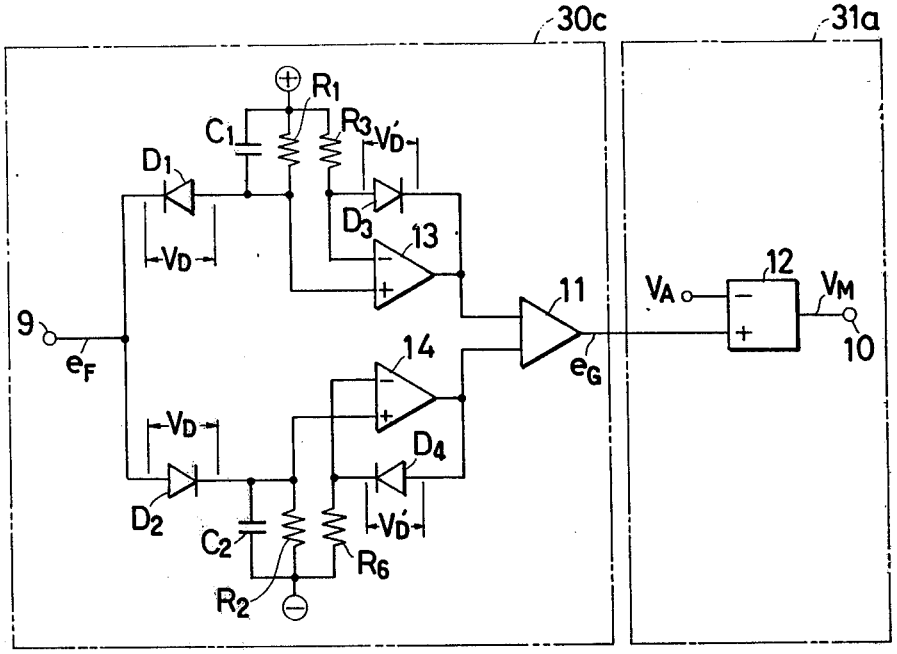

Reference is now made to FIG. 7 which shows the third embodiments **30*c*, 31*a* of the variation range detector 30 and the comparing circuitry 31 in which the voltage drops due to diodes $D_1$ and $D_2$ are further compensated. Parts corresponding to those shown in previous figures are designated by like reference numerals. A pair of operational amplifiers 13, 14 are provided in this embodiment. The noninverting input of the operational amplifier 13 is connected to the anode of the diode $D_1$ while the inverting input of same is connected via a resistor $R_5$ to the positive terminal "⊕" of the power source. The noninverting input of the operational amplifier 14 is connected to the cathode of the diode $D_2$ while the inverting input of same is connected via a resistor $R_6$ to the negative terminal "⊖" of the power source. A pair of diodes $D_3$, $D_4$ are respectively connected across the operational amplifiers 13, 14 in which the anode of the diode $D_3$ is connected to the inverting input of the operational amplifer 13 and the cathode of the diode $D_4$ to the inverting input of the operational amplifier 14. The outputs of each operational amplifier 13, 14 are respectively connected to the inputs of the difference signal generator 11**.

As described before, the potential of the charge in the capacitor $C_1$ is higher than the real minimum level by the voltage drop $V_D$. The output signal of the operational amplifier 13 is fed back via the diode $D_3$ to the inverting input of same and the noninverting input is fed with the potential across the capacitor $C_1$. The voltage at the output of the operational amplifier 13 is lower than that of inverting input by the voltage drop $V'_D$ across the diode $D_3$. When the same diode characteristics are exhibited by the diodes $D_1$, $D_3$ and the resistance of the resistor $R_5$ is equal to that of the resistor $R_1$, the voltage drop $V'_D$ is equal to the voltage drop $V_D$ because the same amount of electric current flows through both diodes $D_1$ and $D_3$. Therefore the output voltage of the operational amplifier 13 is exactly equal to the minimum level. In the same manner the output voltage of the other operational amplifier 14 is exactly equal to the maximum level. With this arrangement the third embodiment shown in FIG. 7 provides an accurate difference between the maximum and minimum levels at the output of the difference signal generator 11. Since the output signal of the difference signal generator 11 is accurate, the closed loop fuel control system is disabled or actuated desirably. The output impedances of the maximum and minimum signals are also considerably small.

Figure 8:
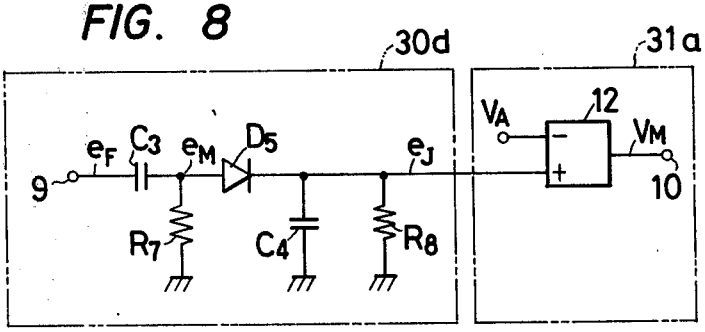

Reference is now made to FIG. 8 which shows the fourth embodiments **30*d*, 31*a* of the variation range detector 30 and the comparing circuitry 31. A capacitor $C_3$ is connected between the input port 9 and the anode of a diode $D_5$ where the anode is connected through a resistor $R_7$ to the ground. The cathode of the diode $D_5$ is coupled to an input of the comparator 12 while a parallel circuit of a capacitor $C_4$ and a resistor $R_8$ are interposed between the cathode of the diode $D_5$ and the ground. The other input of the comparator 12** is fed with a reference signal $V_A$ as same as those embodiments described hereinbefore.

The capacitor $C_3$ and the resistor $R_7$ constitute a high-pass filter which produces a signal $e_H$ which is responsive to the AC component, i.e. the variation range of the output signal $e_F$ of the gas sensor. This signal $e_H$ is rectified by the diode $D_5$ then smoothed by the smoothing circuit consisting of the capacitor $C_4$ and the resistor $R_8$ so as to be effectively a DC signal $e_J$. Since the magnitude of the signal $e_J$ is responsive to that of the signal $e_F$ of the gas sensor, the signal $e_J$ may be utilized in the same manner as in the first embodiment shown in FIG. 4.

The circuit of FIG. 8 is advantageous in that it is simple in construction and may be easily and inexpensively produced via the assembly of a few basic components. However the circuit shown in FIG. 8 suffers from the possibility of a malfunction due to a noise and a ripple included in the DC output. In order to prevent the above-mentioned malfunction it is preferable to disable the feedback control when the magnitude of the control signal $V_M$ is lower than a predetermined level for a predetermined period of time.

Figure 9:
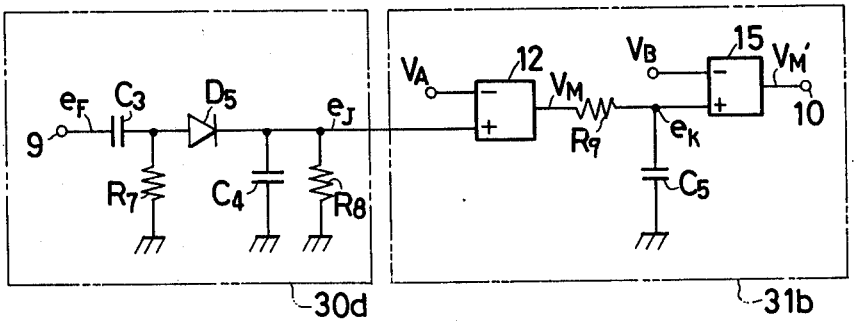

Reference is now made to FIG. 9 which shows the fifth embodiments 30*d*, 31*b* of the variation range detector 30 and the comparing circuitry 31. From the input port 9 to the comparator 12 the same construction is provided as in the forth embodiment and corresponding elements are designated by like reference numerals. The output of the comparator 12 is connected through a resistor $R_9$ to another comparator 15 while a capacitor $C_5$ is provided between the positive input of the comparator 15 and the ground. A reference signal $V_B$ is fed to the negative input of the comparator 15. The resistor $R_9$ and the capacitor $C_5$ constitute an averaging circuit into which the output signal $V_M$ of the comparator 12 is fed.

When the magnitude of the signal $V_M$ is maintained at a low level the voltage $e_K$ across the capacitor $C_5$ decreases. The comparator 15 produces an output signal $V_{M'}$ of high level, when the magnitude of the reference signal $V_B$ is greater than that of the signal $e_K$. With this arrangement any malfunction due to noise or ripple is prevented.

Figure 10:
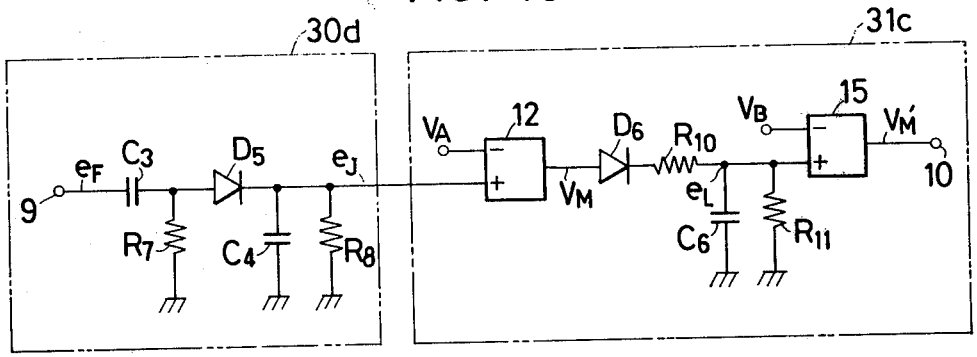

Though the circuit shown in FIG. 9 is effective for preventing the malfunction, this circuit is not suitable for detecting whether the signal $V_M$ is maintained for a predetermined period of time or not when the variation range of the output signal $e_F$ of the gas sensor varies. Hence reference is now made to FIG. 10 which shows the sixth embodiments 30*d*, 31*c* of the variation range detector 30 and the comparing circuitry 31. The construction of the circuit shown in FIG. 10 is the same as the circuit shown in FIG. 9 except that a diode $D_6$ and a resistor $R_{11}$ are provided. The same resistor as the resistor $R_9$ and the same capacitor as the capacitor $C_5$ shown in FIG. 9 are respectively denoted by $R_{10}$ and $C_6$. The diode $D_6$ is interposed between the output of the comparator 12 and the resistor $R_{10}$ while the resistor $R_{11}$ is connected in parallel with the capacitor $C_6$. The resistance of the resistor $R_{10}$ is considerably smaller than that of the resistor $R_{11}$. When the capacity of the comparator 12 is so large as to increase the output current to an adequate extent, the resistance of the resistor $R_{10}$ may be zero. With this arrangement the capacitor $C_6$ is charged instantaneously by the high voltage of the output signal $V_M$ when the variation range of the output signal $e_F$ of the gas sensor is greater than a reference signal even though the output signal $V_M$ is present for a very short period of time. Because of this instantaneous charge the voltage $e_L$ across the capacitor $C_6$ rises to a high level. As the magnitude of the output signal $e_F$ decreases, the output signal $V_M$ of the comparator 12 falls to a low level and the charge of the capacitor $C_6$ is gradually discharged through the resistor $R_{11}$ due to the reverse bias of the diode D, and thus the voltage $e_L$ lowers gradually. The comparator 15 produces an output signal $V_M$, of low level when the voltage $e_L$ is smaller than the magnitude of the reference signal $V_B$. Since the voltage $e_L$ suddenly rises to a high level upon presence of an instantaneous high voltage of the signal $V_M$ while discharging, the comparator 15 produces the output signal $V_{M'}$ only when the output signal $V_M$ is maintained at low level for a predetermined period of time.

Above-described comparing circuits 31*b*, 31*c* shown in FIGS. 9 and 10 in which a signal $V_M$, is produced by using signal $V_M$ may be utilized for those circuits shown in FIGS. 4, 6, 7 and same effect is obtained. All these circuits shown in FIGS. 4 to 9 except FIGS. 5A, 5B are utilized for producing a disable signal as described hereinbefore. However, with a small change in connection these circuits may be utilized for activating the closed loop fuel control. In order to utilize these circuits for this purpose, the two input terminals of the comparators 12 are reversed so that the comparator 12 produces its output signal $V_M$ when the magnitude of the reference signal $V_A$ is greater than that of the input signal $e_G$ or $e_J$. Other operations are the same as those described hereinbefore.

When the above-mentioned circuits are utilized for disabling the feedback contrl, means for reactivating the same is required. Hereinafter are described some methods and devices by which reactivating of the feed back control is performed. In the above-mentioned circuits the feedback control is disabled upon the presence of the signal $V_{M'}$ of low level. Therefore these circuits may be utilized for reactivating the feedback control where the closed loop fuel control is reactivated upon the presence of the signal $V_{M'}$ of a high level.

When the closed loop fuel control system is disabled, the air/fuel ratio may suddenly change to a great extent. At this instant the range of the variation of the output signal $e_F$ suddenly varies to a great extent. Therefore if the disabling and the reactivating of the feedback control is performed in accordance with the detection of the range of variation, activation and reactivation of the feedback control is performed alternately. Rapid cycling causes an unstable control of the air/fuel ratio. In order to prevent this rapid cycling it is deemed to be advantageous to retain hysterisis characteristics in the reference signal $V_A$.

Figure 11:
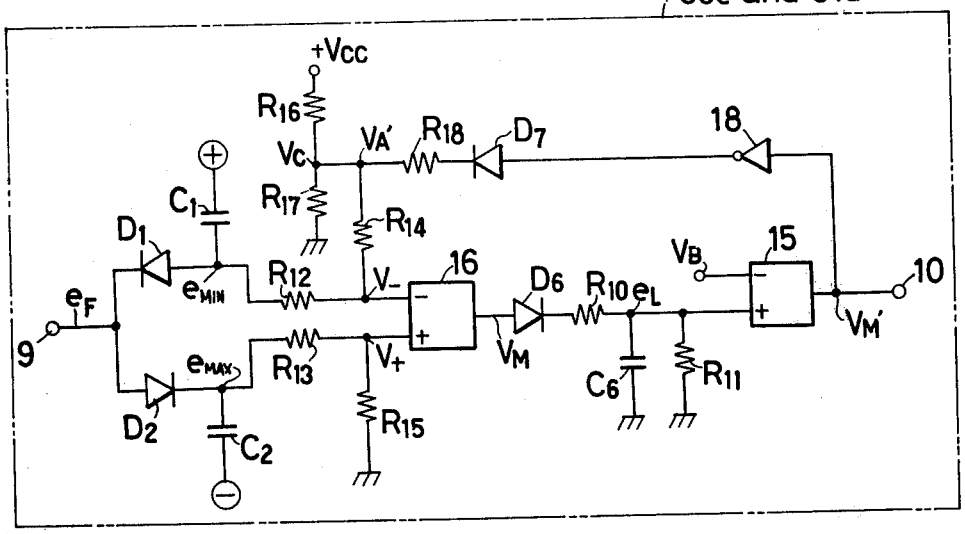

Reference is now made to FIG. 11 which shows the seventh embodiments of the variation range detector 30 and the comparing circuitry 31. The connection of the diodes $D_1$, $D_2$ and capacitors $C_1$, $C_2$ are the same as the circuit shown in FIG. 4 except that the anode of the diode $D_1$ and the cathode of the diode $D_2$ are respectively connected via resistors $R_{12}$, $R_{13}$ to inputs of a comparator 16. A resistor $R_{15}$ is interposed between a positive input of the comparator 16 and the ground. A pair of resistors $R_{16}$, $R_{17}$ are connected in series and thus constitute a voltage divider where a resistor $R_{14}$ is interposed between the connection of the voltage divider and the negative input of the comparator 16. The output of the comparator 16 is connected via a diode $D_6$ and a resistor $R_{10}$ to a positive input of the comparator 15 where the other arrangement of the connection between these two comparators is the same as in the circuit shown in FIG. 9. The output of the comparator 15 is connected via an inverter 18, a diode $D_7$ and resistor $R_{18}$ to the voltage divider. The resistances of resistors $R_{12}$ to $R_{15}$ are arranged to be same. Assuming the respective input voltages of the inputs of the comparator 16 $V_-$ and $V_+$, these voltages are given by the following equations where $V_{A'}$ is a voltage produced by the voltage divider.

$$V_+ = \frac{1}{2}(e_{MAX}), \quad V_- = \frac{1}{2}(e_{MIN} + V_{A'})$$

Therefore the comparator 16 produces an output signal $V_M$ of high voltage when $V_+$ is greater than $V_-$. This means that the comparator 16 compares the magnitude of the difference between the maximum level $e_{MAX}$ and minimum level $e_{MIN}$ and the $V_{A'}$.

When the resistances of resistors $R_{16}$ to $R_{18}$ are considerably small compared to the resistances of resistors $R_{12}$ to $R_{15}$, the voltage $V_{A'}$ is determined by the resistances of resistors $R_{16}$ and $R_{18}$ with little influence from the minimum voltage $e_{MIN}$. No current flows through the diode $D_7$ when the output voltage $V_{M'}$ is at high level, i.e. the output of the inverter 18 is at low level for instance at zero volt. Therefore the following equation is obtained when $V_{CC}$ is the voltage of the power supply.

$$V_{A'} = V_{CC} \times \frac{R_{17}}{R_{17} + R_{16}} \quad (1)$$

If the variation range indicated by $e_{MAX}$–$e_{MIN}$ becomes smaller than the voltage $V_{A'}$ and the same condition is maintained for a predetermined period of time, the voltage $V_B$ becomes greater than that of $e_L$ as in the sixth embodiment shown in FIG. 10 thus the feedback control is disabled when the output level of the inverter 18 becomes high, for instance at $V_{CC}$, upon the low level of the voltage $V_M$, the following equation is derived:

$$V_{A'} = V_{CC} \times \frac{R_{17}}{R_{17} = \frac{R_{16}R_{18}}{R_{16} + R_{18}}} \quad (2)$$

It is understood through comparing these two equations that the $V_{A'}$ of the equation (2) is higher than that of the equation (1) becomes following relationship exists.

$$R_{16} > \frac{R_{16}R_{18}}{R_{16} + R_{18}}$$

This means that after the feedback control is disabled, the reference voltage $V_{A'}$ becomes higher than before via hysterisis characteristics, and that the feedback control is not reactivated unless the variation range becomes larger than that at which the feedback control is disabled. With this hysterisis characteristic the rapid cycling of the on/off operation of the closed loop fuel control is prevented. The charges stored in the capacitors $C_1$, $C_2$ are arranged to be discharged through the resistors $R_{12}$ to $R_{15}$ therefore a resistor such as $R_0$ shown in FIG. 4 may be omitted. The reason why the output of the gas sensor 3 shown in FIG. 1 varies broadly is that the feedback control is disabled when the variation range of the output of the gas sensor 3 becomes small upon the small variation range of the air/fuel ratio of the exhaust gas because of reasons other than the gas sensor being unable to produce a wider range of output signal when the temperature of the gas sensor is very low. Therefore it is better to test whether the temperature of the gas sensor 3 is really low or not by arbitrarily increasing the variation range of the air/fuel ratio. Since the gas sensor is generally at low temperature when the idling mode of engine operation is maintained for a long period of time, it is preferable to test the variation range of the output of the gas sensor during idling via increase of the variation range of the air/fuel ratio.

In a closed loop fuel control circuit, a proportional control and an integral control are generally employed, therefore it is necessary to increase the variation range of either the proportional control or integral control in order to increase the variation range. However, since increase of the integral component may cause unstable control, it is preferable to increase the proportional component.

Figure 12:
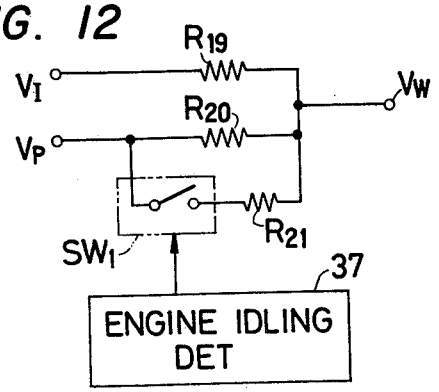
FIG. 12 shows part of the circuitry connected to a P-I controller of the feedback control system, which functions to modify the signal fed to the fuel supply means.

Reference is now made to FIG. 12 which shows an embodiment of a circuit utilized for increasing the proportional component. Since the control signal generator 5 shown in FIG. 1A includes a P-I (proportional-integral) controller, the circuit shown in FIG. 12 may be connected to the control signal generator 5. In FIG. 12 $V_I$ and $V_P$ respectively indicate voltages of an intergrated signal and a proportionally amplified signal by the P-I controller. A pair of resistors $R_{19}$, $R_{20}$ are connected in series and fed with the above-mentioned signals respectively while the connection between the two resistors $R_{19}$, $R_{20}$ is provided as an output terminal. A resistor $R_{21}$ is connected in parallel with the resistor $R_{20}$ via a switch $SW_1$ which is closeable in response to a signal fed from an engine idling detector 37. In this embodiment the engine detector 37 produces its output signal in response to the idling state of the engine operation. In order to detect the idling state the angular displacement of the throttle valve (not shown) may be detected and the switch $SE_1$ may be arranged to close when the angular displacement of the throttle is zero. Further it is possible to arrange to close the switch $SW_1$ by detecting the engine rotational speed, where the switch $SW_1$ may be closed when the engine rotational speed is less than a predetermined value during detection of a fully closed throttle valve.

If in operation, except idling state, since the switch $SW_1$ is open, the voltage $V_W$ obtained at the output terminal is given by the following equation.

$$V_W = \frac{R_{20}}{R_{19} + R_{20}} V_I + \frac{R_{19}}{R_{19} + R_{20}} V_P$$

The ratio of the proportional component to the integral component of the output voltage $V_W$ is given by:

$$\frac{R_{19}}{R_{19} + R_{20}} = \frac{1}{1 + \frac{R_{20}}{R_{19}}} \quad (3)$$

If in operation in idling state, since the switch $SW_1$ is closed, the output voltage $V_W$ is given by:

$$V_W = \frac{\frac{R_{20}R_{21}}{R_{20} + R_{21}}}{R_{19} + \frac{R_{20}R_{21}}{R_{20} + R_{21}}} V_I + \frac{R_{19}}{R_{19} + \frac{R_{20}R_{21}}{R_{20} + R_{21}}}$$

The ratio of the proportional component to the integral component of the output voltage $V_W$ is given by:

$$\frac{R_{19}}{R_{19} + \frac{R_{20}R_{21}}{R_{20} + R_{21}}} = \frac{1}{1 + \frac{\frac{R_{20}R_{21}}{R_{20} + R_{21}}}{R_{19}}} \quad (4)$$

It is to be understood that the ratio of the proportional component of the output voltage $V_W$ given by the equation (4) is greater than that of the output voltage $V_W$ given by the equation (3).

As another method of increasing the proportional component, the gain of an adder utilizing an operational amplifier may be changed by varying the resistance of a resistor connected thereto. Further as another method of detecting the idling state, the idling state may be detected by detecting the gear ratio of the transmission or by detecting the position of the acceleration pedal. These detecting means may be combined as well as those described before such as the angular displacement of the throttle valve.

As described hereinbefore seven embodiments are provided and shown in FIG. 4 to FIG. 11. In these embodiments, the feedback control is disabled and reactivated in accordance with the variation range of the output signal of the gas sensor. However, it is possible to arrange these circuits where the disabling of the feedback control is performed in accordance with the variation range of the output signal and the reactivating of same is performed in accordance with some other engine operational parameters of the vehicle.

In starting operation during cold weather, although the temperature of the exhaust gas rises quickly and further since the thermal capacity of the gas sensor is relatively small, the temperature of the exhaust gas rises quickly, the temperature of the engine takes a relatively long time to rise due to the large thermal capacity thereof. Thus during this period it is preferable to feed a rich air-fuel mixture to the engine to obtain stable operation during warming up. Therefore, during warming up operation, it is sometimes preferable to disable the feedback control until the engine temperature rises to a given level even though the gas sensor is workable.

Figure 13:
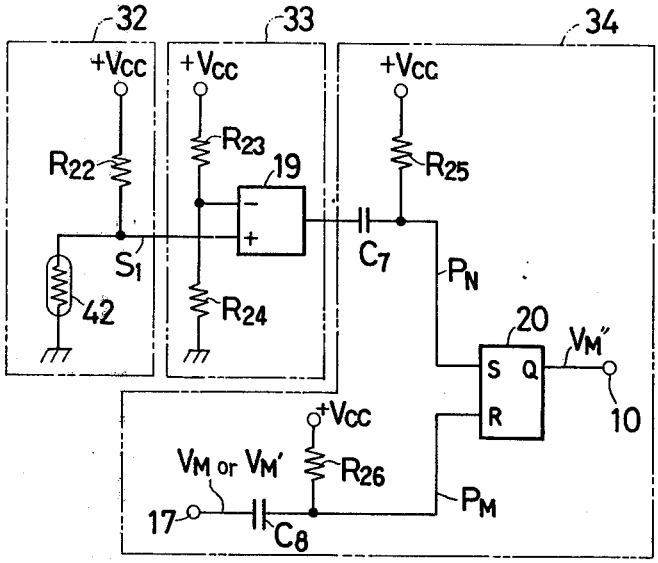
FIG. 13 shows an embodiment of the engine parameter detector, the comparator and the disable-reactivate control signal generator shown in FIG. 1B.

Reference is now made to FIG. 13 which shows an embodiment of the engine parameter detector 32, the comparator 33 and the bistable circuit 34 shown in FIG. 1B in which reactivating of the feedback control is performed in the above-mentioned manner. An input terminal 17 is provided for receiving the output signal $V_M$ or $V_{M'}$ produced by those circuits shown in FIG. 4 to FIG. 11. A capacitor $C_8$ is interposed between the input terminal 17 and a reset terminal of a flip-flop circuit 20 while the rest terminal of same is connected via a resistor $R_{26}$ to a positive power supply $+V_{CC}$. A thermistor 42 is interposed between a positive input of a comparator 19 and the ground while a resistor $R_{22}$ is interposed between the same input of the comparator 19 between the positive power supply $+V_{CC}$. A pair of resistors $R_{23}$, $R_{24}$ are connected in series and both ends thereof are respectively connected to the positive power source and the ground. The connection between the these two resistors $R_{23}$, $R_{24}$ is connected to a negative input of the comparator 19. The output of the comparator 19 is connected via a capacitor $C_7$ to a set input of the flip-flop circuit 20 while the set input is connected via a resistor $R_{25}$ to the positive power supply. The output Q of the flip-flop circuit 20 is connected to an output terminal 10. The capacitor $C_8$ and resistor $R_{26}$ constitute a first differential circuit. The flip-flop circuit 20 is arranged to be set and reset upon respective input signals of low level. When the input signal $V_M$ or $V_{M'}$ is at low level the first differential circuit produces a differential pulse signal $P_M$ and thus the flip-flop circuit is reset where the output signal $V_{M'}$ is at low level.

The thermistor 42 is arranged to detect the temperature of the coolant and has negative temperature coefficiency. Therefore in case the temperature of the coolant increases the resistance of the thermistor 42 decreases and thus the voltage at the positive input of the comparator 19 decreases. When this voltage decreases below the voltage fed to the negative input the output voltage $V_{M''}$ of the flip-flop circuit 20 rises to high level because the output of the comparator 19 is at low level at which a second differential circuit $C_7$, $R_{25}$ produces a differential pulse $P_N$ and the flip-flop circuit 20 is set. This means that the signal $V_{M''}$ falls to a low level when the variation range of the output of the gas sensor 3 is less than a predetermined value while the signal $V_{M''}$ rises to a high level when the temperature of the engine exceeds a predetermined level. Therefore this signal $V_{M''}$ may be utilized for disabling and reactivating of the feedback control.

In this embodiment a thermistor 42 is employed for sensing the engine temperature as shown in FIG. 13. However, other temperature sensing means such as bimetallic thermometer and thermal ferrite may be utilized.

Also it is possible to arrange the above-mentioned circuit to produce a reactivating signal in response to other engine operational conditions. For instance, the reactivating signal may be produced when the engine rotational speed is over a predetermined value or when the temperature of the exhaust gas exceeds a predetermined level. Further it may be also possible to produce the reactivating signal upon the output signal of a logic circuit which produces its output signal in response to at least two signals representative of engine operational conditions such as idling state and engine rotational speed.

Figure 14:
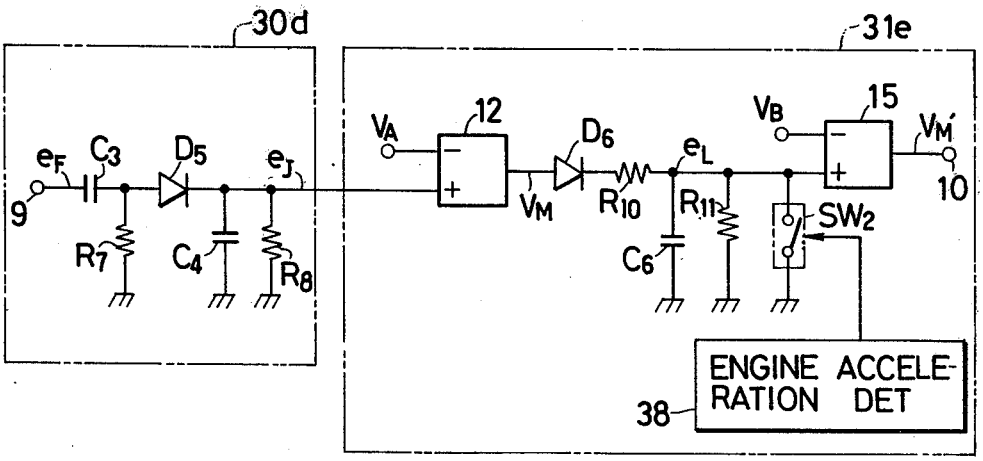
FIGS. 14 and 15 show the eighth and ninth embodiments of combinations of the variation range detector and the comparing circuit shown in FIG. 1B.
Figure 15:
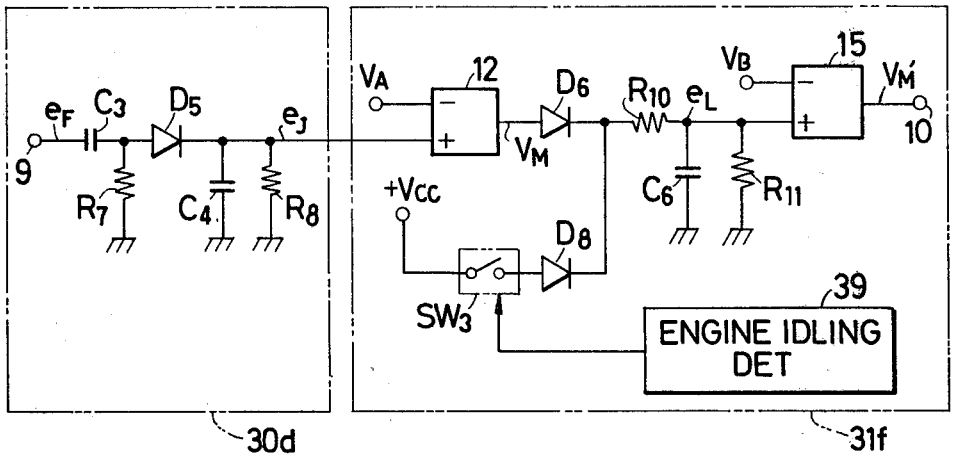

Reference is now made to FIGS. 14 and 15 in which the eighth and ninth embodiments 30*d*, 31*e*, 31*f* of the variation range detector 30 and the comparing circuit 31 are shown. Corresponding parts are designated by the same reference numerals as used in FIG. 10. The circuit shown in FIG. 14 is same as the circuit shown in FIG. 10 except that a switch $SW_2$ is provided between the positive input of the comparator 15 and the ground. This switch $SW_2$ is arranged to close the contacts thereof upon presence of a signal indicating an accelerating state of the engine operation which is detected by an acceleration detector 38. In order to detect the accelerating state the switch $SW_2$ may be connected to the acceleration pedal of the vehicle where the switch $SW_2$ closes when the pedal is depressed. The charge in the capacitor $C_6$ is instantaneously discharged upon closure of the switch $SW_2$ through same to the ground. Thus the voltage $e_L$ of the positive input of the comparator 15 is at low level or zero and the comparator 15 produces at its output an output signal $V_{M'}$ of low level. The feedback control is disabled upon the output signal $V_M$ falling to a low level. In this embodiment the feedback control is disabled upon at least one of two conditions, i.e. the small variation range of the output signal of the gas sensor 3 and the accelerating state. This means that logic OR of two conditions is detected.

The circuit 31*f* shown in FIG. 15 has the same construction as the circuit 31*c* shown in FIG. 10 except that the circuit includes a diode $D_8$ and a switch $SW_3$ connected in series. The cathode of the diode $D_8$ is connected to the cathode of the other diode $D_6$ while the anode of the diode $D_8$ is connected via the switch $SW_3$ to the positive power source $+V_{CC}$. The switch $SW_3$ is arranged to close during various engine operational conditions except idling state. The idling state is detected by an engine idling detector 39 where the detector 39 produces its output signal during various engine operational conditions except idling state. During engine operation other than idling the capacitor $C_6$ is charged via the above-mentioned switch $SW_3$ and the diode $D_8$ and thus the input voltage $e_L$ of the comparator 15 is maintained at a high level. Therefore the output signal $V_{M'}$ of the comparator 15 is at high level. With this arrangement the feedback control is not disabled even though the variation range of the output signal of the gas sensor 3 assumes lower than a predetermined level. Therefore two conditions, i.e. the small variation range of the output signal of the gas sensor 3 and the idling state, are simultaneously necessary to disable the feedback control. This means logic AND of two conditions is detected.

The circuit shown in FIG. 12 is utilized for varying the air/fuel ratio during idling state as described hereinbefore. However, when the engine is operated in steady state as well as idling state without acceleration or deceleration the air/fuel ratio does not change. Therefore the output of the gas sensor 3 does not change except for variations due to temperature fluctuation. When engine is started and is operated in steady state while the vehicle is running very slowly, the feedback control may not be reactivated even though the temperature of the gas sensor is over the predetermined level because of small variation range of the output signal of the gas sensor 3. Therefore it is preferable to test if the output of the gas sensor 3 varies by varying the air/fuel ratio during the above-mentioned condition. In order to perform this test a dither or sawtooth wave signal is added to the control signal produced by the control signal generator 5 shown in FIG. 1A, with which the air/fuel ratio is varied, when the feedback control is disabled.

Figure 16:
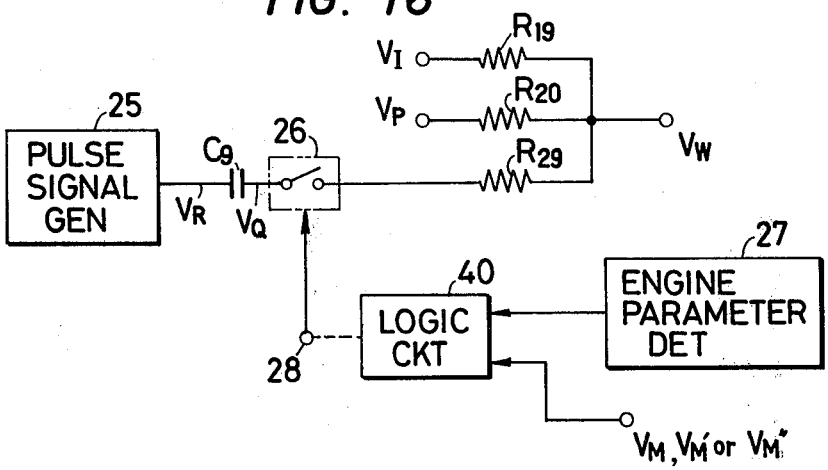
FIG. 16 shows a part of the circuitry connected to the P-I controller of the feedback control system, which functions to modify the signal fed to the fuel supply means.
Figure 17:
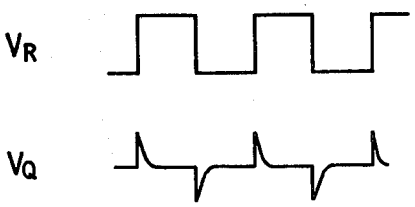
FIG. 17 shows waveforms of signals produced in the circuitry shown in FIG. 16.

Reference is now made to FIG. 16 and FIG. 17, FIG. 16 shows an embodiment utilized for performing the above-mentioned examination. The circuit shown in FIG. 16 may be connected to the control signal generator 5 shown in FIG. 1A. Resistors $R_{19}$, $R_{20}$ are connected in the same manner as in the circuit shown in FIG. 12. A pulse generator 25 is provided and the output of the pulse generator 25 is connected via a capacitor $C_9$, a switch 26 and a resistor $R_{29}$ to the connection between the resistors $R_{19}$ and $R_{20}$. Since this circuit is connected to the outputs of a P-I controller, the integrated signal $V_I$ and the proportionally amplified signal $V_P$ are added and thus an output signal $V_W$ is produced at its output. The pulse signal generator 25 generates a train of rectangular pulses and the switching circuit 26 is arranged to be operated in response to a signal applied to a terminal 28. Therefore the switching circuit 26 may be operated in response to one of beforementioned output signals $V_M$, $V_{M'}$ or $V_{M''}$ in which the switching circuit 26 is closed when the feedback control is disabled.

The output pulse signal $V_R$ shown in FIG. 16 of the pulse signal generator 25 is fed to the capacitor $C_9$ and thus differentiated. The differentiated signal $V_Q$ which is also shown in FIG. 16 is fed through the switching circuit 26 and the resistor $R_{29}$ to the connection between a pair of resistors $R_{19}$ and $R_{20}$. With this arrangement the output signal $V_W$ varies periodically becuase of the dither or sawtooth wave signal $V_Q$. The air/fuel ratio of the air-fuel mixture varies periodically upon the variation of the output signal $V_W$ and thus the variation range of the output of the gas sensor 3 increases when the temperature of the gas sensor 3 is over the predetermined level. Therefore the feedback control of the closed loop fuel control is reactivated positively.

When the engine operational condition is unstable it is not preferable to add such a dither or sawtooth wave signal. Also when the temperature of the coolant is very low, when high output of accelerating operation is required or when engine braking operation is performed, it is not preferable to do so. During the above-mentioned conditions the switching circuit 26 of the circuit shown in FIG. 16 may be opened so as to block the dither or sawtooth wave signal. For blocking the dither or sawtooth wave signal a plurality of engine or vehicle operational parameters such as throttle valve angular displacement, intake air vacuum, engine rotational speed, vehicle velocity, coolant temperature, intake air temperature, lubricating oil temperature, exhaust gas temperature (gas sensor temperature), gear ratio, clutch pedal position, brake pedal position and acceleration pedal position may be detected by an engine parameter detector 27. These parameters may be applied to a suitable logic circuit 40 and the accurate engine operational condition is obtained where the switching circuit 26 is controlled in accordance with the output signal of the logic circuit 40 as the connection is shown by a dotted line in FIG. 16.

What is claimed is:

1. A closed loop control system, in which feedback control of air/fuel ratio of the air-fuel mixture of an internal combustion engine is performed, including: a gas sensor disposed in the exhaust passage of the engine for producing a first signal representative of the concentration of a component of the gases indicating the instantaneous air/fuel ratio of the air-fuel mixture supplied to the engine; a first difference signal generator connected to said gas sensor for producing a signal representative of the difference in magnitude between said first signal and a first reference signal representative of a desired air/fuel ratio; a control signal generator connected to said first difference signal generator for producing a first control signal in response to the difference signal; and fuel supply means arranged to supply fuel to said engine, the amount of fuel being controlled in response to said first control signal; wherein the improvement comprises:

(a) variation range detecting means connected to said gas sensor for producing a second signal representative of the difference between maximum and minimum levels of said first signal;

(b) disable-reactivate control signal generating means connected to said variation range detecting means for producing a second control signal in response to at least said second signal; and (c) disable-reactivate means connected to said control signal generator and said disable-reactivate control signal generating means, said disable-reactivate means being arranged to disable and reactivate said feedback control in response to said second control signal.

2. A closed loop control system as claimed in claim 1, wherein said disable-reactivate control signal generating means includes first comparing means comprising at least a first comparator which produces a third signal when said second signal is less than a second reference signal in magnitude, said first comparing means producing a fourth signal in response to said third signal generated therein.

3. A closed loop control system as claimed in claim 2, wherein said fourth signal is utilized as said second control signal.

4. A closed loop control system as claimed in claim 2, wherein said disable-reactivate control signal generating means further includes a first engine operational condition detecting means for producing a fifth signal indicating an engine operational condition, second comparing means connected to said first engine operational condition detecting means for producing a sixth signal representing greater magnitude of said fifth signal than a third reference signal, and a bistable circuit connected to said second comparing means and said first comparing means, said bistable circuit being arranged to produce said second control signal in response to said fourth signal and said sixth signal.

5. A closed loop control system as claimed in claim 2, wherein said second reference signal is arranged to vary in response to said third signal.

6. A closed loop control system as claimed in claim 2, wherein said second reference signal is arranged to vary in response to said fourth signal.

7. A closed loop control system as claimed in claim 4, wherein said first engine operational condition detecting means includes a temperature sensor.

8. A closed loop control system as claimed in claim 7, wherein said temperature sensor is disposed in the coolant of said engine.

9. A closed loop control system as claimed in claim 7, wherein said temperature sensor is disposed in the exhaust gas passage of said engine.

10. A closed loop control system as claimed in claim 1, wherein said variation range detecting means includes a maximum level detector, a minimum level detector and a second difference signal generator, said maximum and minimum level detectors respectively detecting the maximum and minimum levels of said first signal, said second difference signal generator generating said second signal in response to the difference between said maximum and minimum levels.

11. A closed loop control system as claimed in claim 1, wherein said variation range detecting means includes a rectifier circuit in which AC voltage of said first signal is converted into DC voltage, said DC voltage being utilized as said second signal.

12. A closed loop control system as claimed in claim 2, wherein said comparing means further comprises an averaging circuit connected to said first comparator for averaging said third signal and a second comparator connected to said averaging circuit for producing said fourth signal when output voltage of said averaging circuit is greater than a fourth reference signal.

13. A closed loop control system as claimed in claim 2, wherein said first comparing means further comprises a charge-discharge circuit connected to said first comparator for averaging said third signal and a second comparator connected to said charge-discharge circuit for producing said fourth signal when the output voltage of said charge-discharge circuit is greater than a fourth reference signal.

14. A closed loop control system as claimed in claim 13, wherein said charge-discharge circuit includes a diode, a first resistor, a capacitor connected in series with said first resistor and a second resistor connected in parallel with said capacitor, the resistance of said first resistor being arranged to be smaller than that of said second resistor.

15. A closed loop control system as claimed in claim 1, further comprising, a second engine operational condition detecting means for producing a seventh signal when a signal representative of a specific engine operational condition is greater than a predetermined value in magnitude and proportional component increasing means connected to said control signal generator for increasing the proportional component of a P-I controller included in said control signal generator in response to said seventh signal.

16. A closed loop control system as claimed in claim 15, wherein said second engine operational condition detecting means is an idling state detector.

17. A closed loop control system as claimed in claim 2, wherein said first comparing means further comprises third engine operational condition detecting means for producing an eighth signal when a signal representative of a specific engine operational condition is greater than a predetermined value in magnitude, and logic operating means for producing said fourth signal in response to said third signal and said eighth signal.

18. A closed loop control system as claimed in claim 17, wherein said logic operating means is arranged to produce said fourth signal upon presence of said third signal and said eighth signal.

19. A closed loop control system as claimed in claim 17, wherein said logic operating means is arranged to produce said fourth signal either upon presence of said third signal or said eighth signal.

20. A closed loop control system as claimed in claim 1, further comprising a sawtooth wave signal generator for producing a sawtooth wave signal and switching means interposed between said sawtooth wave signal generator and said control signal generator, said sawtooth wave signal being arranged to be superimposed on said first control signal upon closure of said switching means.

21. A closed loop control system as claimed in claim 20, wherein said switching means is arranged to close in response to said second control signal.

22. A closed loop control system as claimed in claim 20, further comprising fourth engine operational condition detecting means for producing a ninth signal indicating an engine operational condition and a logic circuit for producing an output signal with which said switching means is closed in response to said second control signal and said ninth signal.

* * * * *